US005850827A

United States Patent [19]

Peck

[11] Patent Number: 5,850,827

[45] Date of Patent: Dec. 22, 1998

[54] RECEIVER FOR ARROW NOCK AND RELEASE AID

[75] Inventor: Paul L. Peck, Fond du Lac, Wis.

[73] Assignee: Tru-Fire Corporation, North Fond du Lac, Wis.

[21] Appl. No.: 824,504

[22] Filed: Mar. 26, 1997

[51] Int. Cl.[6] ..... F41B 5/18

[52] U.S. Cl. ..... 124/91

[58] Field of Search ..... 124/35.2, 90, 91

[56] References Cited

U.S. PATENT DOCUMENTS

| | | | |
|---|---|---|---|
| 4,981,128 | 1/1991 | Garvison | 124/35.2 |
| 5,499,620 | 3/1996 | Summers | 124/91 |
| 5,537,986 | 7/1996 | Summers | 124/91 |
| 5,680,851 | 10/1997 | Summers | 124/35.2 |
| 5,715,805 | 2/1998 | Summers et al. | 124/91 |

*Primary Examiner*—John A. Ricci
*Attorney, Agent, or Firm*—Robert C. Curtfiss; Mark A. Tidwell; Bracewell & Patterson

[57] ABSTRACT

The invention provides an arrow nock receiver that forms a barrier around an arrow nock seated therein and physically separates the area in which the arrow nock seats from the area in which a bow string release may be attached. The receiver is defined by an arrow nock protection portion and a bow string release attachment portion. These portions are isolated from one another to prevent a bow string release from inadvertently dislodging an arrow nock seated within the receiver. The arrow nock portion is comprised of an open-mouthed first frame with opposing ends and an arcuate section. Disposed within the arcuate section is a flange. The flange is narrow enough to permit an arrow nock to seat over it, yet wide enough to prevent attachment of a release device. The bow string release attachment portion of the invention is comprised of a second frame integrally formed with, although offset from, the first frame of the arrow nock protection portion. In a second embodiment, the bow string release attachment portion is open-mouthed and positioned directly behind the first frame of the arrow nock portion. In a third embodiment, the bow string release attachment portion is a ball rather than the open-mouthed frame of the second embodiment. A forth embodiment provides a ball-shaped release attachment portion that is offset from the arrow nock portion. In a fifth embodiment, the flange of the first embodiment is replaced with a cylinder mounted within the first frame of the arrow nock protection portion of the device.

54 Claims, 4 Drawing Sheets

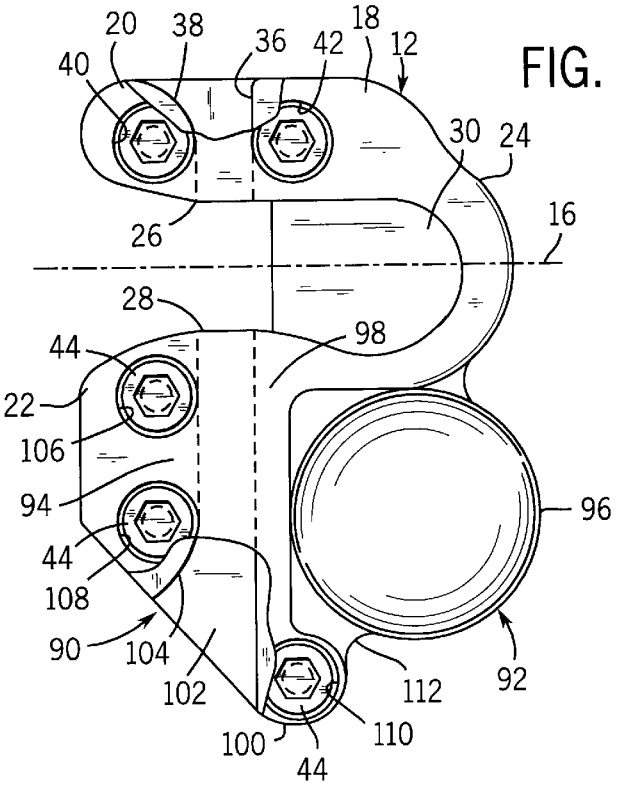
FIG. 4
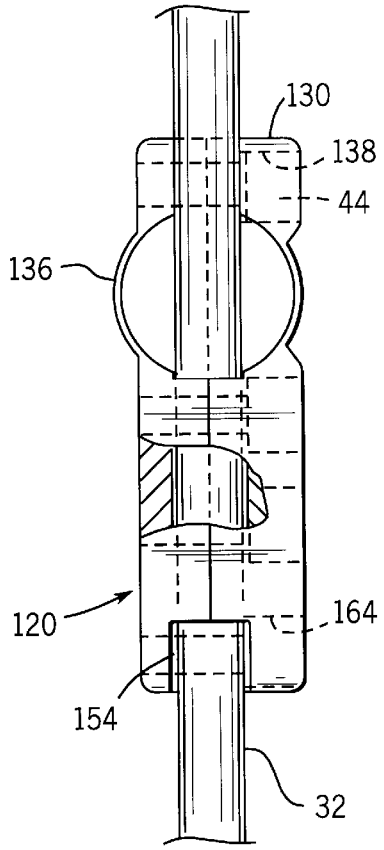
FIG. 6
FIG. 5
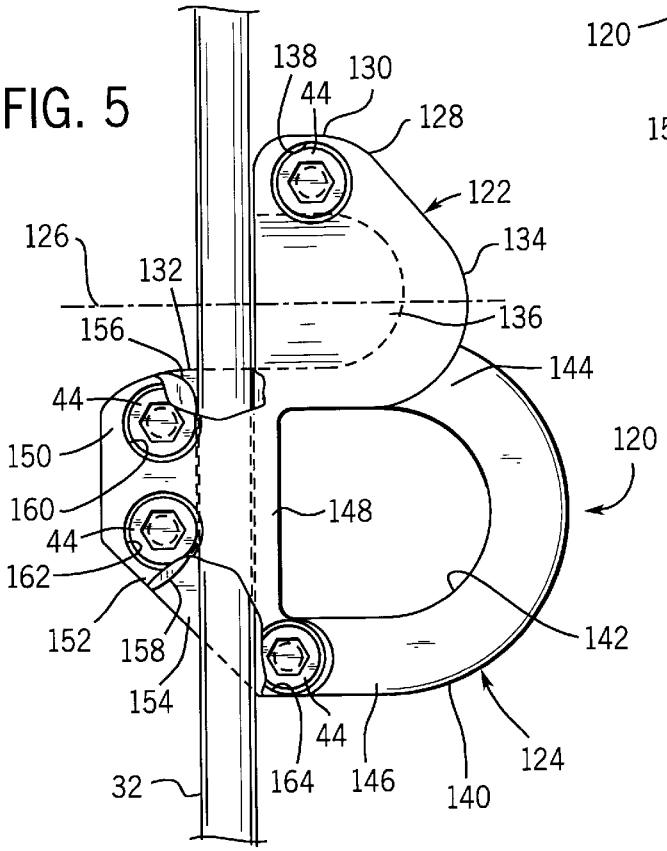

RECEIVER FOR ARROW NOCK AND RELEASE AID

BACKGROUND OF INVENTION

1. Field of Invention

The subject invention is generally related to an arrow nock receiver for archery bow strings, and is specifically directed to an arrow nock receiver to which a bow string release can be attached.

2. Description of the Prior Art

Various forms of mechanical archery bow string release aids have become increasingly popular in recent years because they provide uniform control of a bow string and an increase in accuracy by effecting a consistent, controlled release of an arrow. Such release aids are typically used to maintain the bow string in a cocked position in which the bow string is flexed against the tension of a bow for propelling an arrow supported on the bow string. When a drawn bow string is released from a release aid, the release is usually relatively rapid and at a point approximately in line with the centerline of the bow so that the bow string delivers most of its thrust directly along the major axis of the arrow. When tabs or fingers are used to release a bow string, the bow string tends to roll off the fingers or tab and be deflected sideways during release such that the bow string follows a serpentine path, failing to deliver most of its energy directly along the major axis of the arrow.

Most release aids employ a trigger to activate a bow string retaining and release mechanism. Typically, such mechanisms utilize either pivotable jaws or a pin and flexible eyed loop as the sear means for retaining the bow string. Some release aids attach directly to the corresponding bow sting and other release aids cooperate with bow string mounted anchors or arrow nock holders having portions adapted to be engaged by the release aids. In any event, the release aids attach at or near the centerline, adjacent the arrow, to enhance thrust of the arrow.

An arrow itself is generally comprised of a shaft with a point mounted on one end and a nock mounted on the opposite end. A standard arrow nock has a bow string receiving groove or notch defined by spaced apart legs. The notched nock is configured to receive a bow string, insuring stability of the arrow during cocking and release of the bow string. When an arrow is loaded on a bow in this manner, the legs of the arrow nock extend beyond the bow string toward the archer such that an arrow can pivot from side to side about the bow string. As with the release aid described above, the nock of the arrow is preferably disposed at or near the mid-point of the bow string to insure that the flight of the arrow is as true as possible.

To further ensure that the arrow is properly aligned each time it is loaded on the bow string, guide elements such as balls or nock rings may be attached near the bow string's mid-point. For example, a nock ring may be attached on either side of the bow string mid-point, spaced apart approximately the width of the arrow nock, permitting an arrow to be retained on the string between the guides. The guide elements may also serve as the anchor or point of attachment for the above-described release aids.

Several prior art references teach structures that attach to bow strings to support an arrow nock and provide a point of attachment for a release aid. U.S. Pat. No. 4,086,904 teaches a bow string anchor that attaches to a bow string adjacent arrow nock guide elements. The anchor includes structure that may be releasingly engaged by a bow string release. The device may be utilized with any standard arrow nock. U.S. Pat. No. 5,537,986 teaches a device comprised of an open-mouthed, U-shaped member attached to a bow string for gripping by a bow string release and for positioning a nocked end of an arrow. The ends of the U-shaped member attach to the bow string. An arrow nock seats between the open ends of the U-shaped member such that the legs of the arrow nock extend back towards the arcuate portion of the U-shaped member. A bow string release aid attaches directly to the arcuate portion of the U-shaped member adjacent the legs of the arrow nock. A similar device is taught in U.S. Pat. No. 5,499,620 wherein a cross support bar is disposed between the open ends of a U-shaped member. The cross support bar eliminates width compression/distortion of the U-shaped member and string sag during arrow propulsion. One drawback to devices such as these is the tendency of release aids used in conjunction with the devices to inadvertently contact and unseat arrow nocks supported on the bow string. This is especially true in prior art devices where the legs of the arrow nock extend into the area in which the release aid attaches. A common solution to this problem is to shorten the legs of the arrow nock by trimming them down. This solution is undesirable for several reasons. First, altered arrow nocks may not seat correctly on the bow string. Second, altered arrow nocks may effect the flight of the arrow, which is precisely designed in both balance and aerodynamics.

Therefore, there exists a need for a device that can function as both an attachment point for a release aid and as an arrow nock protector. The device should be designed to allow unaltered arrow nocks to properly seat on a bow string, while protecting the nocks from inadvertent dislodgment by a bow string release mechanism.

SUMMARY OF THE INVENTION

The subject invention provides a receiver/nock protector that physically separates the area in which an arrow nock seats from the area in which a release aid may be attached. By separating these two areas, the release aid is prevented from contacting and dislodging an arrow nock seated on the bow string. The receiver is defined by an arrow nock protection portion or zone and a release aid attachment portion or zone. The nock protection zone and the release aid attachment zone are isolated from one another to prevent a release aid from inadvertently dislodging an arrow nock seated on a bow string to which the subject invention is attached. The arrow nock zone is comprised of an open-mouth first frame having opposing ends and an arcuate portion or bowl therebetween. By way of example, the frame is generally U-shaped, although any shape frame may be used. Each end is provided with a protrusion to permit the arrow nock to rock or pivot in an upward or downward direction about the protrusions. Disposed within the bowl is a web or flange that extends around the curved base of the bowl. The flange is narrow enough to permit an arrow nock to seat over it, yet wide enough to prevent attachment of a bow string release.

The release aid attachment portion of the invention is comprised of a second frame. The second frame may be open-or closed-mouthed. By way of example, the second frame is generally D-shaped, although any shape may be used. In the preferred embodiment, the second frame is integrally formed with the first frame of the arrow nock protection portion. Unlike the arrow nock protection portion, the second frame does not have a flange disposed around its circumference.

In a first embodiment, the release aid attachment portion is offset below and behind the nock protection portion. Thus, the receiver of the invention is provided with two separate means for preventing accidental dislodgment of an arrow nock by a release aid. First, the frame of the nock protection portion, being curved around the arrow nock, physically protects the arrow nock from contact with any type of release aid. The presence of the flange further prevents an archer from attempting to attach a release aid to the arrow nock protection portion of the receiver. Second, the release aid attachment portion is isolated from the nock protection portion and is positioned in an offset 35 manner from the area in which the arrow nock is contained.

In a second embodiment, the release aid attachment portion is also an open-mouthed frame, preferably U-shaped, and positioned directly behind the first frame of the arrow nock portion. Because of the presence of the first frame of the arrow nock portion, as well as the presence of the flange, the release aid attachment portion is still isolated or shielded from the arrow nock portion and accidental dislodgment of an arrow nock by a release aid is prevented. Furthermore, the presence of the release aid attachment portion directly behind the arrow nock portion functions as an additional barrier between an arrow nock seated on the bow string and a release aid.

A third embodiment is similar in configuration to the second embodiment, however, the release aid attachment portion is a ball rather than the open-mouth frame of the second embodiment. The ball attaches directly behind the first frame of the arrow nock protection portion and functions as the structure to which a release aid attaches. Because of the presence of the first frame of the arrow nock portion, as well as the flange, the release aid attachment portion remains physically separated from the arrow nock portion such that accidental dislodgment of the arrow nock by a release aid is prevented. Furthermore, the presence of the ball directly behind the arrow nock portion functions as an additional barrier between an arrow nock seated on the bow string and a release aid.

In a fourth embodiment, the elements of the first and third embodiments are combined to provide an offset bow string release attachment portion formed of a ball rather than an open- or closed-mouth frame. Again, however, the attachment portion remains isolated from the arrow nock portion and the presence of the flange prevents attachment of a release aid to the arrow nock protection portion of the receiver.

Finally, a fifth embodiment of the invention replaces the flange of the first embodiment with a cylinder. The cylinder is attached between the open ends of an open-mouth frame and is disposed to cover an arrow nock seated on bow string. Because the cylinder covers the arrow nock, including the legs of the arrow nock, the arrow nock is protected from contact with a bow string release.

BRIEF DESCRIPTION OF THE DRAWINGS

FIG. 4 is a cut-away side view of a fourth embodiment of the invention in which the release aid attachment structure is a ball offset below the frame of the arrow nock protection portion.

FIG. 5 is a cut-away side view of a fifth embodiment of the invention in which the arrow nock protection portion includes a bell housing to cover an arrow nock.

FIG. 6 is a cut-away front view of the embodiment of FIG. 5.

DETAILED DESCRIPTION OF THE PREFERRED EMBODIMENTS

In the detailed description of this invention, like numerals are employed to designate like parts throughout.

Various items of equipment, such as fasteners, fitting, etc., may be omitted to simplify the description. However, those skilled in the art will realize that such conventional equipment can be employed as desired.

Figure 1:
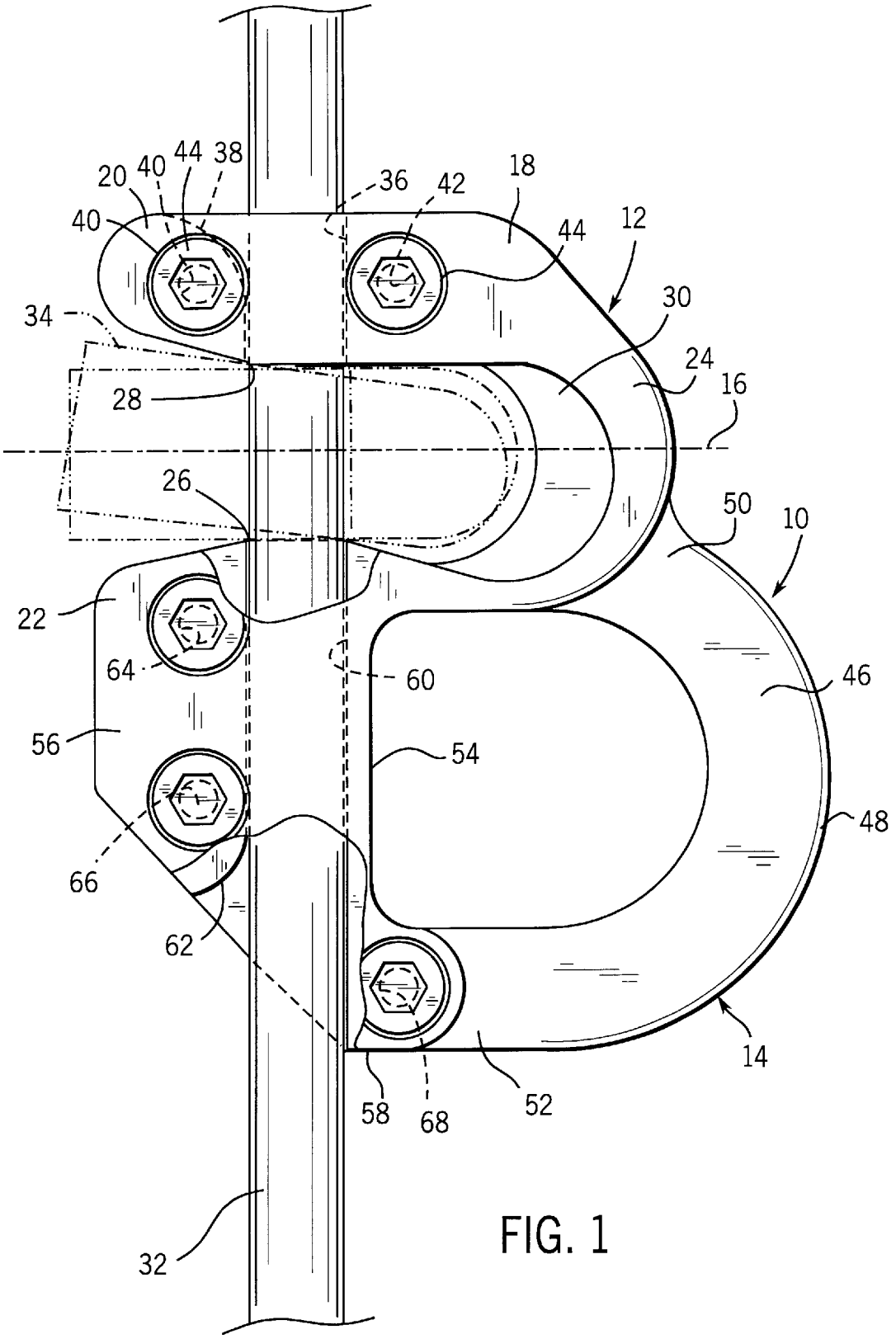
FIG. 1 is a cut-away side view of the arrow nock receiver of the current invention, wherein the attachment structure for a release aid is a closed-mouth frame offset from the arrow nock protection portion.

With reference to FIG. 1, the receiver of the present invention is shown and designated as 10. Receiver 10 defines an arrow nock protection portion or zone 12 and a release aid attachment portion or zone 14. Arrow nock portion 12 is defined along a centerline 16 and is comprised of an open-mouth, first frame 18 having opposing ends 20, 22 and an arcuate portion or bowl 24 therebetween. Each end 20, 22 is provided with a protrusion 26, 28. A plate, web or flange 30 may be attached or formed within first frame 18. Preferably, if present, flange 30 is disposed about the inner circumference of arcuate portion 24. Receiver 10 is shown attached to a bow string 32 with an arrow nock 34 seated thereon. End 20 has a slot 36 through which bow string 32 extends. Slot 36 is provided with a rounded edge 38 to prevent damage to bow string 32. Disposed on either side of slot 36 are fastener bores 40, 42 for receipt of fasteners 44. By way of example, open-mouth first frame 18 is generally U-shaped, although those skilled in the art will understand that frame 18 may be of any shape suitable for receiving and protecting an arrow nock.

Release aid attachment portion 14 is formed of a second frame 46, similar to first frame 18 of arrow nock protection portion or zone 12. As is seen in FIG. 1, second frame 46 is offset from the centerline 16 of first frame 18. Second frame 46 may be open- or closed-mouth or may take any shape suitable for attaching a bow release aid. In the one embodiment, second frame 46 is, by way of example, a closed-mouth, generally D-shaped frame. In another embodiment, second frame 46 is, by way of example, open-mouthed and generally U-shaped. In any event, second frame 46 is a distinct structure from frame 18.

Turning to the specific elements of an embodiment with a generally D-shaped frame, second frame 46 has an arcuate portion 48, an upper leg 50, a lower leg 52, and a cross-member 54 therebetween. Cross-member 54 is defined by an upper end 56 and a lower end 58 and is provided with a slot 60 extending between upper end 56 and lower end 58. Slot 60, also disposed for receipt of bow string 32, is provided with a rounded edge 62 to prevent damage to bow string 32. Disposed on either side of slot 60 are fastener bores 64, 66, 68 for receipt of fasteners 44.

If second frame 46 is open-mouthed, i.e., without a cross member 54, then second frame 46 is similar to first frame 18.

In the embodiment of FIG. 1, release aid attachment portion 14 is integrally formed with arrow nock protection portion 12 such that the upper end 56 of second frame 46 merges with end 22 of first frame 18 and upper leg 50 merges with the arcuate portion 24 of first frame 18. Receiver 10 is disposed for attachment to bow string 32 via slots 38 and 60 such that cross-member 54 is substantially aligned with bow string 32 when receiver 10 is attached thereto. Receiver 10 may be split into halves (as shown in FIG. 1) or may be provided with a plate (not shown) for attachment to bow string 32. When split into halves, fastener bores 40, 42, 64, 66, and 68 are aligned and fasteners 44 secure the two halves to one another. In such a configuration, the joined halves cooperate to form slots 38 and 60, securely clamping bow string 32 between the two halves. Preferably, the two halves are split in such a way that receiver 10 remains balanced about bow string 32. For example, the two halves may be mirror images of one another or each of the individual halves may be selectively weighed such that their union provides the desired balance about bow string 32.

Protrusion 26 and 28 are provided to permit arrow nock 16 to rock or pivot about the protrusions, allowing arrow nock 16 to self-center between ends 20 and 22 of first frame 18. Furthermore, slots 36 and 60 are provided with rounded edges 38 and 62, respectively, to prevent damage to bow string 32 as bow string 32 bends around these edges, i.e., when bow string 32 is in the drawn position.

In the configuration described above, arrow nock 34, when seated on bow string 32, is protected in several ways. First, open-mouth first frame 18 forms a barrier around arrow nock 34. In addition, receiver portion 12 and release aid portion 14 are isolated from one another such that a bow string release aid (not shown) cannot inadvertently dislodge arrow nock 32. This isolation is accomplished by providing separate structures, namely, first frame 18 and second frame 46, for seating an arrow nock and attaching a release aid, respectively.

Furthermore, flange 30 is provided to prevent attachment of a release aid to first frame 18 rather than second frame 48. Specifically, flange 30 is narrow enough to permit an arrow nock 32 to seat over it, yet wide enough to prevent attachment of a bow string release, including string-type and caliper-type releases. To this end, flange 30 may be formed to be thicker at its base where it attaches to the arcuate portion 24 of first frame 18 and progressively narrower at the open edge of flange 30 over which arrow nock 34 extends. Aside from preventing a bow string release from being attached to first frame 18, flange 30 also functions to maintain the alignment of arrow nock 34, and hence the arrow to which it is attached, by preventing rotation of the arrow and arrow nock about centerline 16.

In addition, flange 30 also prevents receiver 10 from rotating about bow string 32 to interfere with an arrow as the arrow is released. Typically, upon release from a release aid, a receiver will have a tendency to rotate axially about a bow string as the bow string travels back to its undrawn position. In so doing, the receiver may contact an arrow as it is being propelled forward by the bow string, interfering with the arrow's alignment and release. Flange 30 prevents rotation of receiver 10 as bow string 32 is propelling an arrow. Specifically, the legs of arrow nock 34 extend on either side of flange 30, preventing receiver 10 from rotating while arrow nock 34 is contained within first frame 18.

Finally, another benefit of the distinct nature of these the arrow nock protection structure and the release aid attachment structure is that they can be spatially separated from one another to further diminish the chance that a release aid could inadvertently dislodge an arrow nock from a bow string. To this end, the release aid attachment portion 14 is offset from arrow nock receiver portion 12. Specifically, second frame 48 may be offset in such a manner from first frame 18 that the apex of a generally D-shaped second frame 48 is behind the apex of a generally U-shaped first frame 18. In such a configuration, upper leg 50 may be merged into the arcuate portion 24 of first frame 18, further inhibiting attachment of a release aid to this portion of receiver 10.

Figure 2:
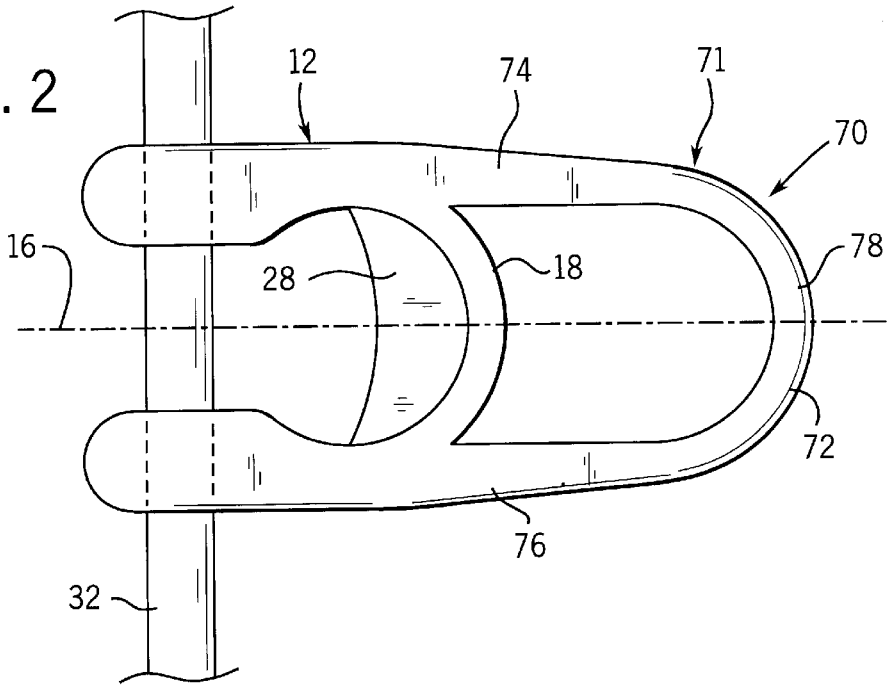
FIG. 2 is a side view of a second embodiment of the invention in which the release aid attachment portion is an open-mouth frame attached behind the arrow nock protection portion.

A second embodiment of the receiver of the invention is shown in FIG. 2 and designated as 70. Receiver 70 generally includes arrow nock portion 12 and release aid attachment portion 71. Release aid attachment portion 71 is comprised of second frame 72 and is attached directly behind first frame 18 of arrow nock portion 12, about centerline 16. Again, although first frame 18 and second frame 72 may be of any shape suitable for receiving an arrow nock and attaching a release aid, respectively, the frames of the second embodiment are described as open-mouthed, and, by way of example, generally U-shaped.

Generally U-shaped second frame 72 is characterized by opposing ends 74, 76 and an arcuate portion 78 therebetween. Second frame 72 is integrally merged with first frame 18 about centerline 16. Arrow nock portion 12 remains the same as described above in the first embodiment, including the presence of flange 30. Again, first frame 18 forms a barrier around arrow nock 34. Flange 30 functions to deter attachment of a release aid to arrow nock portion 12 of receiver 70. Those skilled in the art will understand that arcuate portion 78 of second frame 72 should be small enough in cross-sectional diameter to permit attachment of a standard release aid. On the other hand, the cross-sectional diameter of arcuate portion 24 of first frame 18 may be sized large enough to further inhibit attachment of a release aid.

As with the first embodiment, first frame 18 surrounds the arrow nock, protecting it from accidental dislodgment. Again, flange 30 functions to prevent attachment of a release aid and maintains the alignment of arrow nock 34 and receiver 10. The concept of separating the arrow nock zone and the release aid attachment zone is implemented by providing second frame 72 as the attachment point for a release aid. In addition to providing this separate physical structure for the attachment of a release aid, the location of second frame 72 directly behind first frame 18 further enhances protection of arrow nock 34. Specifically, second frame 72 is positioned directly between the archer and the arrow nock such that frame 72 functions as an additional barrier between arrow nock 34 and a release aid.

Figure 3:
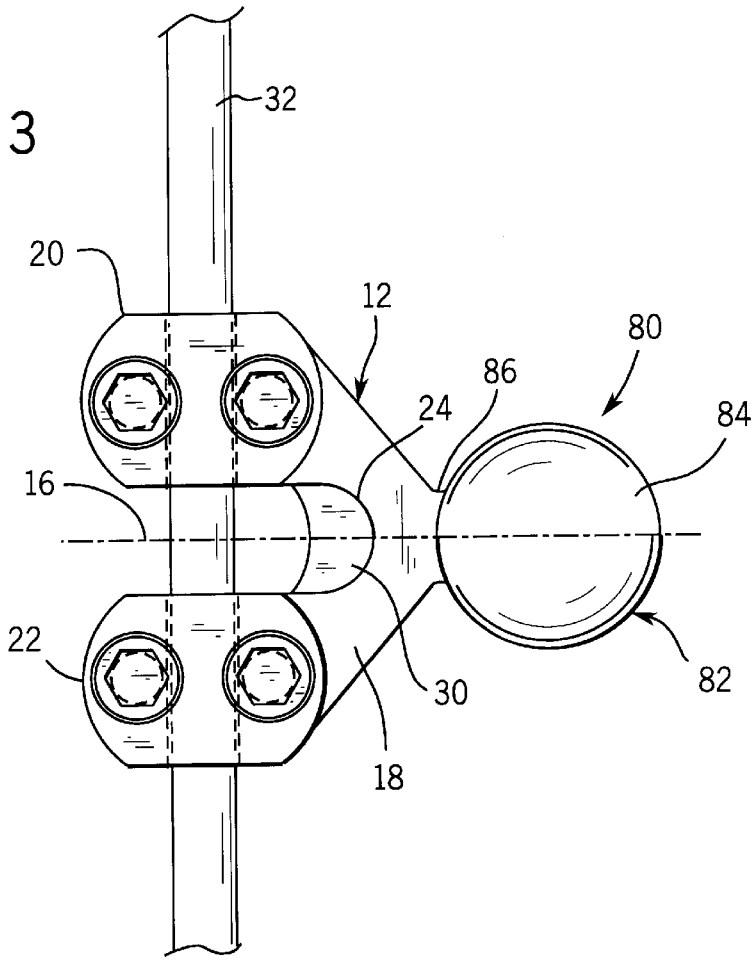
FIG. 3 is a side view of a third embodiment of the invention in which the release aid attachment structure is a ball attached behind the arrow nock protection portion.

A third embodiment of the invention is illustrated in FIG. 3 in which the arrow nock receiver of the invention is designated as 80. Receiver 80 is defined by an arrow nock portion 12 and release aid attachment portion 82. Release aid attachment portion 82 is comprised of a ball 84 attached directly behind first frame 18 of arrow nock portion 12, along centerline 16. Ball 84 may be attached directly to the external arcuate portion 24 of first frame 18 or may be supported on a separate neck 86 extending from frame 18. Arrow nock portion 12 remains the same as described above in the first embodiment, including the presence of flange 30. Again, first frame 18 forms a barrier around arrow nock 34. Flange 30 functions to deter attachment of a release aid to arrow nock portion 12 of receiver 80. The attachment of ball 84 directly behind first frame 18, and generally between the arrow nock and the archer, provides an additional barrier between arrow nock 34 and a release aid. Ball 84 functions as the point of attachment for any standard caliper-type release aid. Ball 84 is generally spherical in shape but may be contoured or formed in any desired shape, such as, by way of example, a square.

A fourth embodiment of the invention is shown in FIG. 4 and designated as arrow nock receiver 90. Receiver 90 includes a release aid portion 92 that incorporates an offset, ball-type attachment frame, such that receiver 90 combines the elements of the first and third embodiments of the invention. Again, arrow nock portion 12 is comprised of a first frame 18 having opposing ends 20, 22 and an arcuate portion or bowl 24 therebetween. Each end 20, 22 is provided with a protrusion 26, 28. Disposed about the inner circumference of arcuate portion 24 is a web or flange 30. End 20 has a slot 36 with a rounded edge 38 at the forward side of the outer end of slot 36. Disposed on either side of slot 36 are fastener bores 40, 42 for receipt of fasteners 44.

Release aid attachment portion 92 is formed of a cross-member 94 and a ball 96 attached thereto. Cross-member 94 is defined by an upper end 98 and a lower end 100 and is provided with a slot 102 extending between upper end 98 and lower end 100. Slot 102 also has a rounded edge 104. Disposed on either side of slot 102 are fastener bores 106, 108, 110 for receipt of fasteners 44. The upper end 98 of cross-member 94 merges with the lower end 22 of first frame 18 such that cross-member 94 extends perpendicularly from first frame 18, permitting alignment of slot 36 and slot 102.

Ball 96 may be attached to cross-member 94 by any standard method. In the preferred embodiment, ball 96 is integrally formed with cross-member 94 and is supported on a flange 112. In addition, ball 96 is offset from the centerline 16 such that ball 96 is below and behind the area in which an arrow nock would rest in frame 18. Ball 96 is generally spherical in shape but may be contoured or formed in any desired shape, such as, by way of example, a square.

Ball 96 is sized for grasping by a release aid. One common release aid (not shown) is a caliper-type device which is provided with opposing jaws that are contoured on their inner surfaces to close around the spherical shape of a ball. The fourth embodiment of the invention would be well suited for use with such a release aid. In any event, the concept of separating the arrow nock zone and the release aid attachment zone is implemented by providing ball 96 as the attachment point for a release aid. Again, first frame 18 surrounds the arrow nock, protecting it from accidental dislodgment. Flange 30 functions to prevent attachment of a release aid and maintains the alignment of arrow nock 34. In addition to providing independent physical structures for seating an arrow nock and attachment of a release aid, the location of ball 96 is spatially separated, i.e., offset, from first frame 18, further diminishing the likelihood that a release aid could accidentally dislodge an arrow nock disposed within first frame 18.

A fifth embodiment of the arrow nock receiver of the invention is shown in FIGS. 5, 6, 7, and 8, and generally designated as 120. Receiver 120 defines an arrow nock protection portion or zone 122 and a release aid attachment portion or zone 124. Arrow nock portion 122 is defined along a centerline 126 and is comprised of a first frame 128 having opposing ends 130, 132 and an arcuate portion or bowl 134 therebetween. Disposed within first frame 128 is a cylinder 136. Receiver 120 is shown disposed on a bow string 32. End 130 has a fastener bore 138 therethrough for receipt of a fastener 44.

In one embodiment, shown in FIGS. 5 and 6, cylinder 136 is a bell housing having a first end that is open and a second end that is closed. The open end of cylinder 136, when formed in the shape of a bell housing as shown in FIG. 6, faces bow string 32 and generally terminates adjacent bow string 32, although if cylinder 136 extends beyond bow string 32, bow string 32 will extend radially through cylinder 136. In another embodiment, shown in FIGS. 7 and 8, both ends of cylinder 136 are open and formed to have differing diameters to accommodate various diameter arrow nocks. For example, the first end may have a first diameter and the second end may have a second diameter, larger than the first diameter. The first end would be disposed for receipt of smaller diameter arrow nocks while the second end would be disposed for receipt of larger diameter arrow nocks. In this embodiment, cylinder 136 is rotatable such that either the first end or the second end may be oriented to be adjacent the bow string. In any event, whether formed as a fixed cylinder, a rotatable cylinder or a bell housing, when cylinder 136 is disposed adjacent a bow string for receipt of an arrow nock, the legs of the arrow nock extend into cylinder 136.

In FIGS. 5 and 6, release aid attachment portion 124 is formed of a second frame 140, similar in shape to first frame 128 of arrow nock protection portion or zone 122. Again, although second frame 140 may be of any shape, in the fifth embodiment, second frame 140 is, by way of example, open-mouthed and generally D-shaped. As is seen in FIG. 5, second frame 140 is offset from the centerline 126 of first frame 128. Generally D-shaped second frame 140 has an arcuate portion 142, an upper leg 144, a lower leg 146, and a cross-member 148 therebetween. Cross-member 148 is defined by an upper end 150 and a lower end 152 and is provided with a slot 154 extending between upper end 150 and lower end 152. Slot 154 has rounded edges 156, 158. Disposed on either side of slot 154 are fastener bores 160, 162, 164 for receipt of fasteners 44.

In this embodiment, release aid attachment portion 124 is integrally formed with arrow nock protection portion 122 such that the upper end 150 of second frame 140 merges with end 132 of first frame 128 and upper leg 144 merges with the arcuate portion 134 of first frame 128. Receiver 120 is disposed for attachment to bow string 32 via slot 154 through which bow string 32 extends such that cross-member 148 is substantially aligned with bow string 32 when receiver 120 is attached thereto. Receiver 120 may be split into halves (as shown in FIGS. 5 and 6) or may be provided with a plate (not show) for attachment to bow string 32. When split into halves, fastener bores 138, 160, 162, and 164 are aligned and fasteners 44 secure the two halves to one another. In such a configuration, the joined halves cooperate to form slot 154, securely clamping bow string 32 between the two halves.

Slot 154 is provided with rounded edges 156, 158 to prevent damage to bow string 32 as bow string 32 bends around these edges, i.e., when bow string 32 is in the drawn position.

Figure 7:
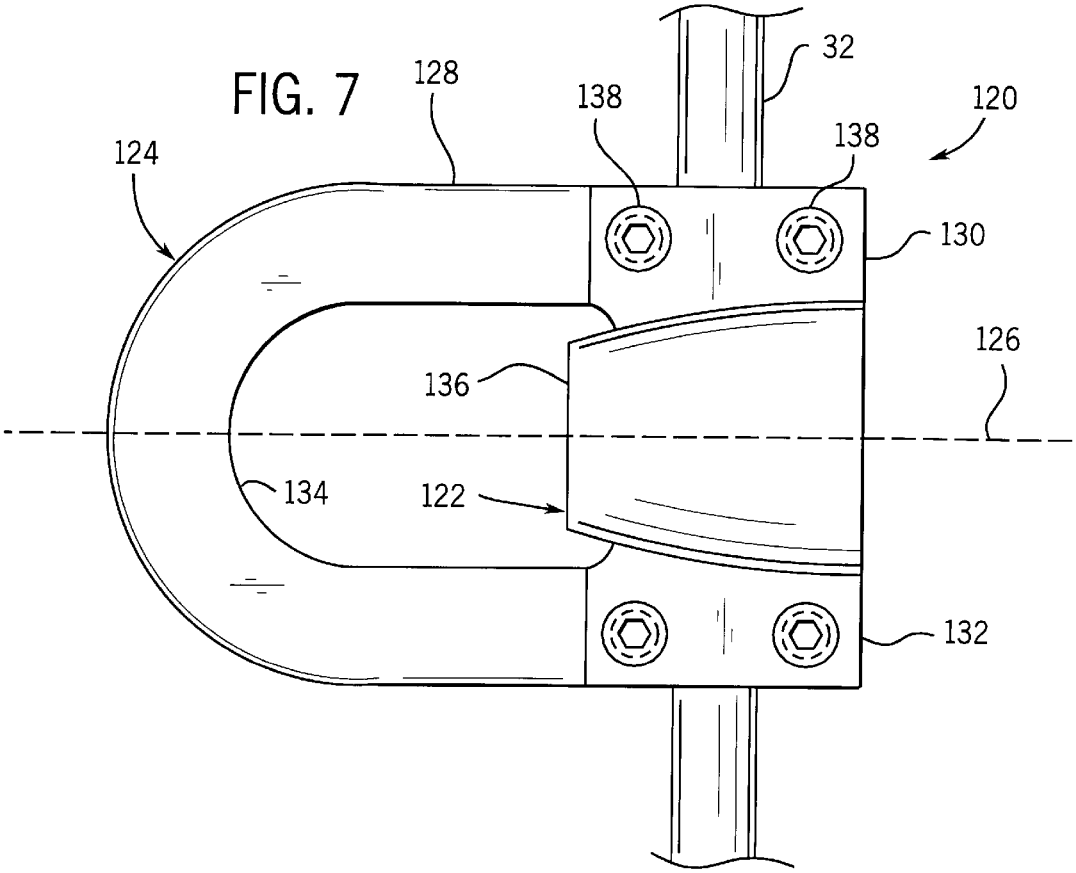
FIG. 7 is a side view of the fifth embodiment of the invention in which the arrow nock protection portion includes a rotatable cylinder.
Figure 8:
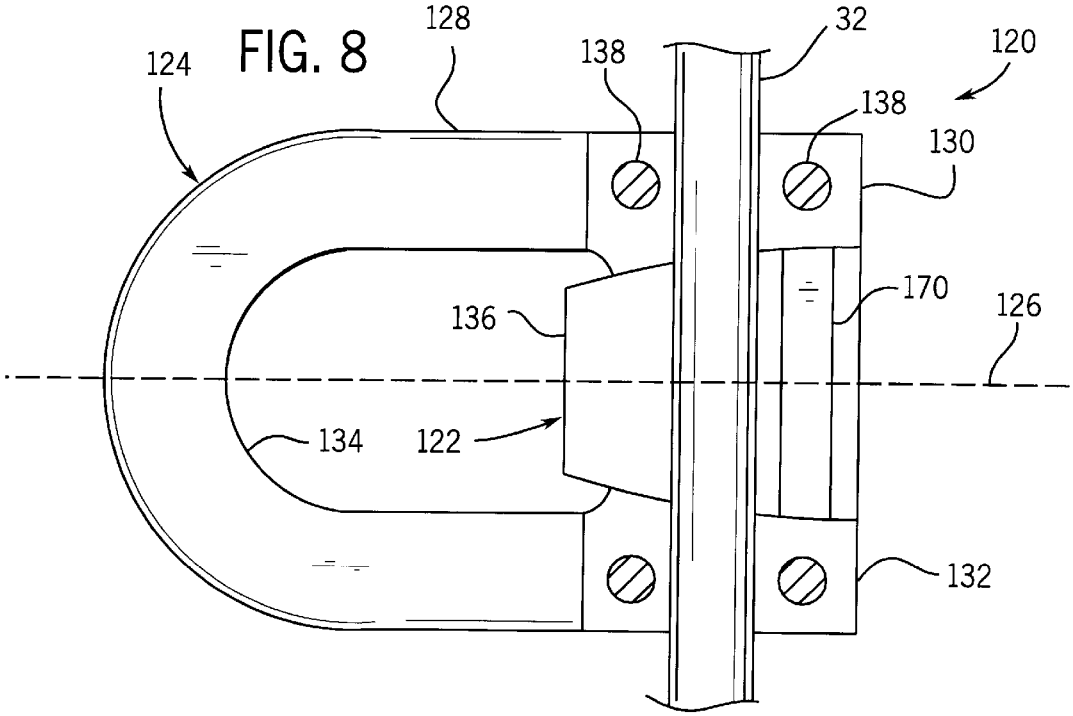
FIG. 8 is a cut-away side view of FIG. 7 and includes an arrow nock loading bar.

In FIGS. 7 and 8, release aid attachment portion 124 is comprised of the first frame 128 that supports cylinder 136. As described below, isolation of arrow nock protection portion 122 from release aid attachment portion 124 is accomplished by the presence of cylinder 136.

In the configuration described above, arrow nock 34, when seated on bow string 32, is protected in several ways. First, by encircling arrow nock 34, cylinder 136 forms a protective barrier around the arrow nock. Because cylinder 136 covers the arrow nock, the arrow nock is protected from contact with a release aid, thus permitting attachment of a release aid adjacent cylinder 136. If formed in the shape of a bell housing, cylinder 136 also prevents attachment of a release aid device to arrow nock portion 122, in a similar way that flange 30 of the first embodiment prevents such attachment. In addition, in the embodiment shown in FIGS. 5 and 6, arrow nock portion 122 and release aid portion 124 are isolated from one another such that a release aid (not shown) cannot inadvertently dislodging arrow nock 32. This isolation is accomplished by providing separate structures for attaching a release aid and for seating an arrow nock.

Furthermore, cylinder 136 also functions to prevent receiver 120 from axially rotating about bow string 32 as an arrow is being propelled forward by the bow string, much in the same way as flange 30 functions as described above in the first embodiment.

The embodiment of FIG. 8 is also provided with an arrow nock loading bar or flange 170 that extends between ends 130 and 132 and is positioned in front of and adjacent to bow string 32. Bar 170 is generally parallel with bow string 32. This permits an arrow nock to seat on bar 170 rather than bow string 32, such that bar 170, rather than bow string 32, actually propels an arrow when bow string 32 is released from a drawn position.

Those skilled in the art will understand that this configuration may be modified utilizing elements of the other described embodiments. For example, arcuate frame 140 of release aid portion 124 may be replaced with a ball as is described in the third and fourth embodiments of the invention. Furthermore, cylinder 136 may be provided with an internal flange to aid in arrow nock and receiver alignment. Bar 170 may be included in any of the above described embodiments to extend the life of a bow string. Finally, the specific shapes of the first and second frames should not be construed as limiting the invention. Although the frames have been described generally as open-or closed-mouthed, and, by way of example, as U-shaped, D-shaped or shaped in the form of a ball, these shapes are only secondary to one of the inventive features of the receiver, namely separate structures for receiving an arrow nock and for attaching a release aid.

Although the invention may be manufactured of any standard material, the receivers of the preferred embodiments are formed of light weight composites or metals, such as aluminum or stainless steel, that are corrosion resistant.

The above described invention provides an arrow nock receiver that also functions as an attachment point for a release aid. Unlike the prior art devices, however, the invention protects an arrow nock seated within the receiver from contact with the release aid utilized in conjunction with the invention. Specifically, the invention provides a protective barrier around an arrow nock seated in the receiver. In addition, the device provides different structures for attachment of a release aid and for receipt of the arrow nock. The structure for receipt of an arrow nock further is provided with elements to prevent attachment of a release aid to the arrow nock protection structure. Finally, the structure for attachment of a release aid and the structure for receipt of the arrow nock are spatially separated from one another to further diminish the likelihood that a release aid could inadvertently unseat an arrow nock. The receiver embodiments of the invention can be utilized with any standard arrow nock without the need to trim down or alter the arrow nock in any way. Furthermore, the receivers increase the useful life of bow strings with which the receivers are used by protecting the bow strings from damage by release aids.

While certain features and embodiments of the invention have been described in detail herein, it will be readily understood that the invention encompasses all modifications and enhancements within the scope and spirit of the following claims.

What is claimed is:

1. A bow string receiver for receiving an arrow nock and for grasping by a release aid, wherein the receiver is attachable to a bow string, said receiver comprising:

a. A first frame for receiving the arrow nock, said first frame disposed to at least partially surround said arrow nock; and b. a second frame, separate from said first frame, said second frame for attaching the release aid.

2. The receiver of claim 1 wherein said first frame is open-mouthed.

3. The receiver of claim 2 wherein said second frame is closed-mouthed.

4. The receiver of claim 1 wherein said second frame is closed-mouthed.

5. The receiver of claim 1 wherein said first frame is U-shaped.

6. The receiver of claim 1 wherein said second frame is D-shaped.

7. The receiver of claim 1 wherein said first frame includes a flange.

8. The receiver of claim 1 wherein said first frame comprises a first end, a second end, a first arcuate portion with a first inner curve and a first outer curve, and said second frame is attached adjacent said first frame.

9. The receiver of claim 8 wherein said first frame includes a flange disposed around the inner curve of the first arcuate portion.

10. The receiver of claim 8 wherein the first end of said first frame includes a first slot extending through the first end.

11. The receiver of claim 8 wherein the second frame includes an upper leg, a lower leg, a second arcuate portion and a cross-member extending between the upper and lower legs.

12. The receiver of claim 11, wherein said cross-member includes a second slot extending therethrough between said upper and lower legs.

13. The receiver of claim 11 wherein the second frame is attached to the first frame such that the second arcuate portion extends behind said first arcuate portion.

14. The receiver of claim 8 wherein the second frame is attached offset from the first frame.

15. The receiver of claim 8 wherein at least one of said ends of the first frame includes an inwardly extending protrusion.

16. The receiver of claim 1 wherein said second frame is U-shaped.

17. The receiver of claim 1 wherein said second frame is open-mouthed.

18. The receiver of claim 1 wherein said first frame comprises a first end, a second end, a first arcuate portion with a first inner curve and a first outer curve; and said second frame comprises a first end, a second end, a second arcuate portion with a second inner curve and a second outer curve, wherein said second frame is attached adjacent the first outer curve of said first frame.

19. The receiver of claim 18 wherein the first frame includes a flange disposed around the inner curve of the first arcuate portion.

20. The receiver of claim 18 wherein the first end of said first frame includes a first slot extending therethrough and the second end of said first frame includes second slot extending therethrough, said first and second slots disposed for receipt of a bow string.

21. The receiver of claim 18 wherein at least one of said ends of said first frame includes an inwardly extending protrusion.

22. The receiver of claim 1 wherein said second frame is a ball.

23. The receiver of claim 1 wherein said first frame comprises a first end, a second end, a first arcuate portion with a first inner curve and a first outer curve, the two ends and arcuate portion defining an outer periphery for said first frame; and said second frame comprises a ball attached adjacent the outer periphery of said first frame.

24. The receiver of claim 23 wherein said first frame is open-mouthed.

25. The receiver of claim 23 wherein said first frame includes a flange disposed around the inner curve of the first arcuate portion.

26. The receiver of claim 23 wherein said ball has at least one flat surface.

27. The receiver of claim 23 wherein said ball is oval.

28. The receiver of claim 23 wherein said ball is attached to the first outer curve of said first arcuate portion.

29. The receiver of claim 23 wherein the first end of said first frame includes a first slot extending therethrough and the second end of said first frame includes a second slot extending therethrough, said first and second slots disposed for receipt of a bow string.

30. The receiver of claim 23 wherein at least one of said ends of said first frame includes an inwardly extending protrusion.

31. The receiver of claim 1 wherein said first frame comprises a first end, a second end, a first arcuate portion with a first inner curve and a first outer curve; and said second frame comprises a cross-member extending perpendicularly from said second end of said first frame and a ball attached to said cross-member.

32. The receiver of claim 31 wherein said first frame is open-mouthed.

33. The receiver of claim 31 wherein said first frame includes a first flange disposed around the inner curve of the first arcuate portion.

34. The receiver of claim 31 wherein said ball has at least one flat surface.

35. The receiver of claim 31 wherein said cross-member includes a second flange to which said ball is attached.

36. The receiver of claim 31 wherein the first end of said first frame includes a first slot extending therethrough, said slot disposed for receipt of a bow string.

37. The receiver of claim 31 wherein said cross-member includes a second slot extending therethrough, said slot disposed for receipt of a bow string.

38. The receiver of claim 31 wherein at least one of said ends of said first frame includes an inwardly extending protrusion.

39. The receiver of claim 1 wherein said first frame includes a cylindrical housing.

40. The receiver of claim 39 wherein said first frame is further defined by a first end, a second end, and a first arcuate portion, said two ends and first arcuate portion defining an inner frame periphery and an outer frame periphery, wherein said cylinder is disposed within the inner periphery of said first frame.

41. The receiver of claim 40 wherein said cylinder is a bell housing having a first end and a second end, wherein the first end of said bell housing is open and disposed adjacent the bow string and the second end of said bell housing is closed and extends around the inner periphery of said first frame.

42. The receiver of claim 40 wherein the first end of said first frame includes a first slot extending through the first end.

43. The receiver of claim 39 further including a flange mounted within said cylinder.

44. The receiver of claim 39 wherein said second frame is a ball.

45. The receiver of claim 39 wherein said second frame is closed-mouthed.

46. The receiver of claim 39 wherein the second frame includes an upper leg, a lower leg, a second arcuate portion and a cross-member extending between the upper and lower legs.

47. The receiver of claim 46, wherein said cross-member includes a second slot extending therethrough between said upper and lower legs.

48. The receiver of claim 46 wherein said second frame is attached to said first frame such that the second arcuate portion extends behind said first arcuate portion.

49. The receiver of claim 39 wherein said second frame is attached offset from said first frame.

50. The receiver of claim 39 wherein said cylinder has a first open end with a first diameter and a second open end with a second diameter.

51. The receiver of claim 50 wherein the first diameter of said first end is smaller than the second diameter of said second end.

52. The receiver of claim 51 wherein said cylinder is rotatable.

53. The receiver of claim 39 further including a bar attached to the first frame, said bar positioned in front of the bow string when said receiver is attached to the bow string, wherein an arrow nock seats on said bar.

54. The receiver of claim 1 further including a bar attached to the first frame, said bar positioned in front of the bow string when said receiver is attached to the bow string, wherein an arrow nock seats on said bar.

* * * * *